US006654569B2

(12) United States Patent
Nozawa

(10) Patent No.: US 6,654,569 B2
(45) Date of Patent: Nov. 25, 2003

(54) TONER CARTRIDGE AND MECHANISM FOR DETECTING REMAINING AMOUNT OF TONER

(75) Inventor: Ken Nozawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 56 days.

(21) Appl. No.: 10/091,326

(22) Filed: Mar. 6, 2002

(65) Prior Publication Data

US 2002/0127023 A1 Sep. 12, 2002

(30) Foreign Application Priority Data

Mar. 9, 2001 (JP) ..... 2001-066650

(51) Int. Cl.[7] ..... G03G 15/08

(52) U.S. Cl. ..... 399/27; 399/262; 399/263

(58) Field of Search ..... 399/24, 25, 27, 399/107, 111, 119, 252, 262, 263; 222/DIG. 1

(56) References Cited

U.S. PATENT DOCUMENTS 5,875,378 A * 2/1999 Campbell et al. ..... 399/263
6,246,854 B1 * 6/2001 Kurosawa et al. ..... 399/263

* cited by examiner

*Primary Examiner*—Hoan Tran
(74) *Attorney, Agent, or Firm*—Rabin & Berdo, PC

(57) ABSTRACT

A toner cartridge has a toner chamber, agitator, damper, and position indicator. The agitator is disposed in the toner chamber and is free to rotate. The agitator is pushed to rotate and agitate the toner. The position indicator attached to the agitator and indicates a rotational position of the agitator. The damper is disposed in a path through which the agitator rotates, the damper defining an angular range through which the agitator rotates while the position indicator is detected by an external device. When the agitator rotates freely into the angular range, the damper damps the motion of the agitator. The damper is formed of a resilient film material and is bent into a base portion, and a raised portion base portion is fixed to an inner surface of the toner chamber and the raided portion extends into the path.

22 Claims, 17 Drawing Sheets

TONER CARTRIDGE AND MECHANISM FOR DETECTING REMAINING AMOUNT OF TONER

FIELD OF THE INVENTION

The present invention relates to a toner cartridge and a mechanism for detecting remaining quantity of toner.

DESCRIPTION OF THE RELATED ART

FIG. 25 illustrates a conventional toner chamber and a toner agitator provided therein.

FIG. 26 illustrates a toner chamber of a conventional toner cartridge when the toner chamber is nearly empty of toner.

FIG. 27 illustrates the toner chamber of the conventional toner chamber when the toner chamber holds a sufficient amount of toner.

FIG. 28 illustrates the output signal of a toner sensor indicative of the remaining toner in the toner chamber.

Referring to FIG. 25, a toner agitator 92 is free to rotate in a toner chamber 91. The toner chamber 91 has a gear, not shown, rotatably attached thereto. The gear 95 has a projection 94 that pushes the toner agitator 92 when the gear 95 rotates. As the gear 95 rotates in a direction shown by an arrow, the projection 94 pushes the toner agitator 92 so that the toner agitator 92 rotates together with the gear 95. When the toner agitator 92 rotates past its highest position in the toner chamber 91, the toner agitator 92 drops due to its own weight. If the toner chamber 91 holds a sufficient amount of toner therein as shown in FIG. 27, the toner agitator 92 leaves the projection 94 to land and rest on a pile of toner. If the toner chamber 91 holds little toner therein as shown in FIG. 26, when the toner agitator 92 rotates past its highest position, the toner agitator 92 drops and rotates to its lowest position due to its own weight. After the toner agitator 92 drops from its highest position, the gear 95 still continues to rotate so that the projection 94 pushes the toner agitator 92 again to rotate together with the toner agitator 92. The toner agitator 92 stays at its lowest position for a longer time period when the toner chamber 91 holds little toner therein than when the toner chamber 91 holds a sufficient amount of toner therein.

A magnet-sensitive toner sensor, not shown, is disposed outside of the toner chamber 91. The toner agitator 92 has a magnet attached thereto. As the toner agitator 92 rotates, the magnet passes the toner sensor. The toner sensor detects the magnetic flux of the magnet and outputs a sensor output as shown in FIG. 28.

Referring to FIG. 26, when the toner agitator 92 is within an angular range $\alpha$, the toner agitator 92 is substantially at its lowest position and the toner sensor outputs a signal indicative of "a toner-low."

The conventional toner agitator 92 suffers from a problem that the toner agitator 92 tends to oscillate back and forth about its lowest position when the toner chamber 91 holds little toner therein.

SUMMARY OF THE INVENTION

An object of the invention is to solve the drawbacks of the aforementioned conventional art. A toner cartridge includes a toner holding section, a toner agitator, a damper, and a position indicator. The toner holding section is a toner chamber that holds toner therein. The toner agitator is disposed in the toner holding section and is free to rotate.

The toner agitator is driven in rotation to agitate the toner when it is pushed to rotate. The damper damps the motion of the toner agitator when the toner agitator rotates freely, the damper being disposed in the toner holding section. The position indicator is attached to the toner agitator and indicates the rotational position of the toner agitator.

The damper is disposed in a path through which the toner agitator rotates, the damper defining an angular range through which the toner agitator rotates while the position indicator is detected by an external device.

The damper is formed of a resilient film material and is bent into a base portion, and a raised portion. The base portion is fixed to an inner surface of the toner holding section and the raised portion extends into the path.

The raised portion exhibits a first resistance against a first force that causes the raised portion, to deform inwardly relative to the angular range and a second resistance against a second force that causes the raised portion to deform outwardly relative to the angular range.

The damper is one of two dampers. A first one of the two dampers is disposed at an upstream end of the angular range with respect to rotation of the toner agitator. A second one of the two dampers is disposed at a downstream end of the angular range with respect to rotation of the toner agitator. The raised portion of the second one of the two dampers lies in a plane at an angle with a plane in which the raised portion of the first one of the two dampers lies.

The toner agitator stays in the angular range for a shorter time when the toner cartridge holds a larger amount of toner therein than when the toner cartridge is nearly empty of toner.

The raised portion has a plurality of slits extending in a direction in which the raised portion extends.

The toner agitator is pushed by a drive member to rotate about a substantially horizontal axis. When the toner agitator is rotated past its vertical highest position, the toner agitator drops from the vertical highest position due to its own weight. When the toner agitator is in the angular range, the external device detects the magnetic field.

The position indicator is a magnet attached to the toner agitator. The magnet radiates a magnetic field that is detected by the external device.

A toner remaining detector for detecting a remaining amount of toner in a toner cartridge attached to an image-forming unit, the detector includes a toner agitator, a position indicator, and a damper. The toner agitator is disposed in the toner cartridge and is free to rotate about an axis. The toner agitator is driven in rotation to agitate the toner. The damper damps the motion of the toner agitator when the toner agitator rotates freely. The position indicator is attached to the toner agitator and transmits a signal indicative of a rotational position of the toner agitator. An external detector is provided on the image-forming unit and detects the signal when the toner agitator is rotated.

The damper is disposed in a path through which the toner agitator rotates, the damper damping the motion of the toner agitator when the toner agitator is within a range of rotational angle.

The damper is formed of a resilient film material bent into a base portion fixed to an inner surface of the toner cartridge and a raised portion extending into the path.

The damper is one of two dampers. A first one of the two dampers is disposed at an upstream end of the range of rotational angle with respect to rotation of the toner agitator. A second one of the two dampers is disposed at a downstream end of the range of rotational angle with respect to rotation of the toner agitator.

The raised portion of the first one of the two dampers has a plurality of slits formed in a direction in which the raised portion of the first one of the two dampers extends.

The second one of the two dampers is disposed such that the raised portion lies in a plane at an angle with the axis.

The toner agitator is rotatable freely about the axis. The second portion operates such that when the toner agitator rotates freely within the range of rotational angle, the second portion repels the toner agitator to stay within the range of rotational angle. The second portion operates such that when the toner agitator is rotated by the drive member, the second portion allows the toner agitator to move out of the range of rotational angle.

The toner agitator is pushed by a drive member to rotate about a substantially horizontal axis. When the toner agitator is rotated past its vertical highest position, the toner agitator drops from the vertical highest position due to its own weight and rotates about the substantially horizontal axis. When the toner agitator is substantially in the range of rotational angle, the signal is detected.

The position indicator is a magnet attached to the toner agitator and radiates a magnetic field. The detector is a magnetoresistive element and detects the magnetic field.

The toner agitator stays within the range of rotational angle for a shorter time when the toner cartridge holds a larger amount of toner therein than when the toner cartridge is nearly empty of toner.

An image-forming unit receives a toner cartridge attached thereto. The toner cartridge includes a toner agitator free to rotate and a position indicator that indicates a rotational position of the toner agitator. The toner agitator is driven in rotation when it is pushed to rotate. The image-forming unit includes a space that receives the toner cartridge therein and a detector that detects the position indicator when the position is at a certain rotational position.

The position indicator is a magnet that radiates a magnetic field and the detector is a magnetoresistive element that detects the magnetic field.

The toner agitator is pushed by a drive member to rotate about a substantially horizontal axis. When the toner agitator is rotated past its vertical highest position, the toner agitator drops from the vertical highest position due to its own weight. When the toner agitator is substantially in the range of rotational angle, the detector detects the magnetic field.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

First Embodiment

{General Construction}

Figure 1:
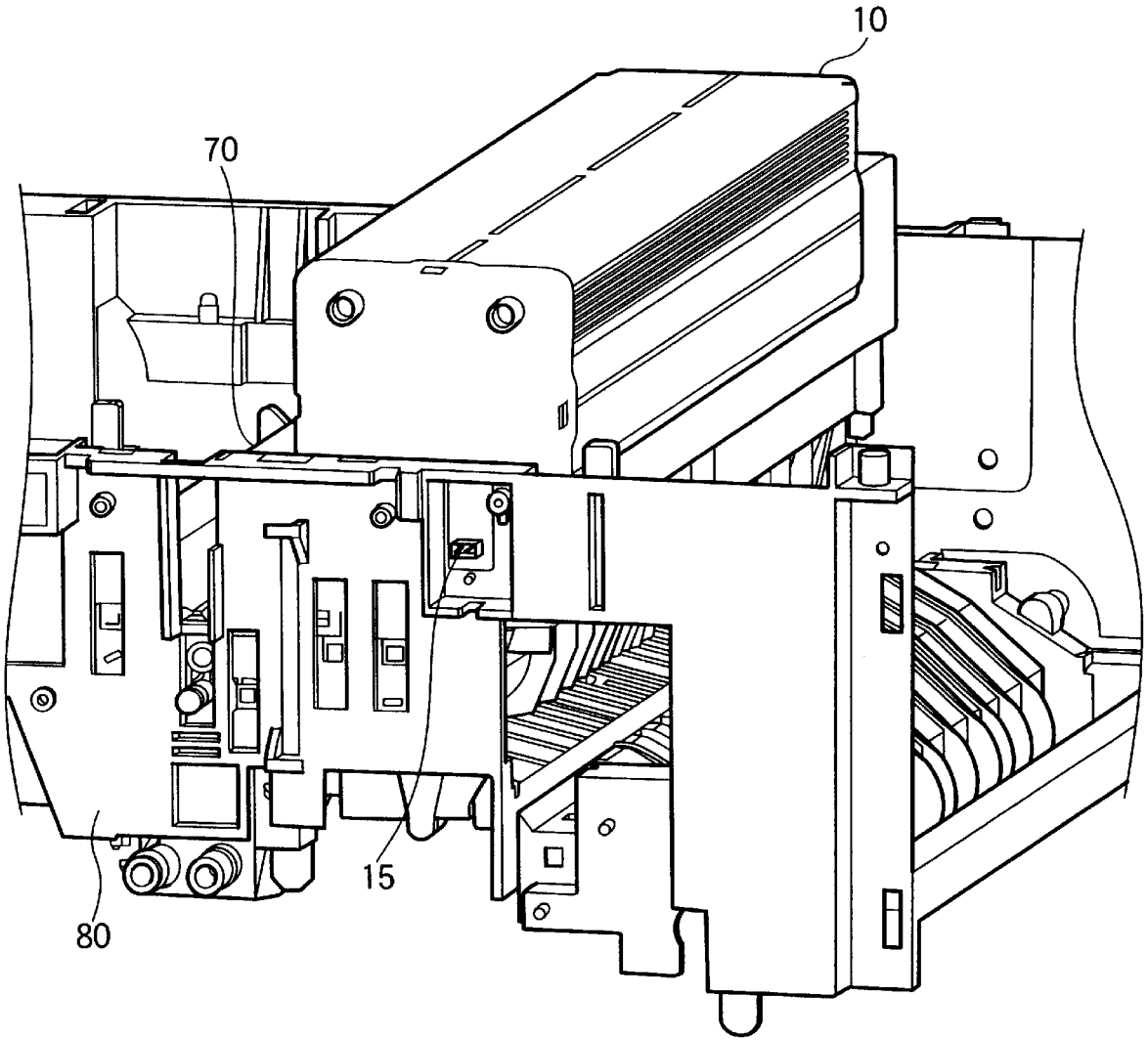
FIG. 1 is a perspective view illustrating a pertinent portion of an image-forming apparatus according a first embodiment.

FIG. 1 is a perspective view illustrating a pertinent portion of an image-forming apparatus according a first embodiment.

Figure 2:
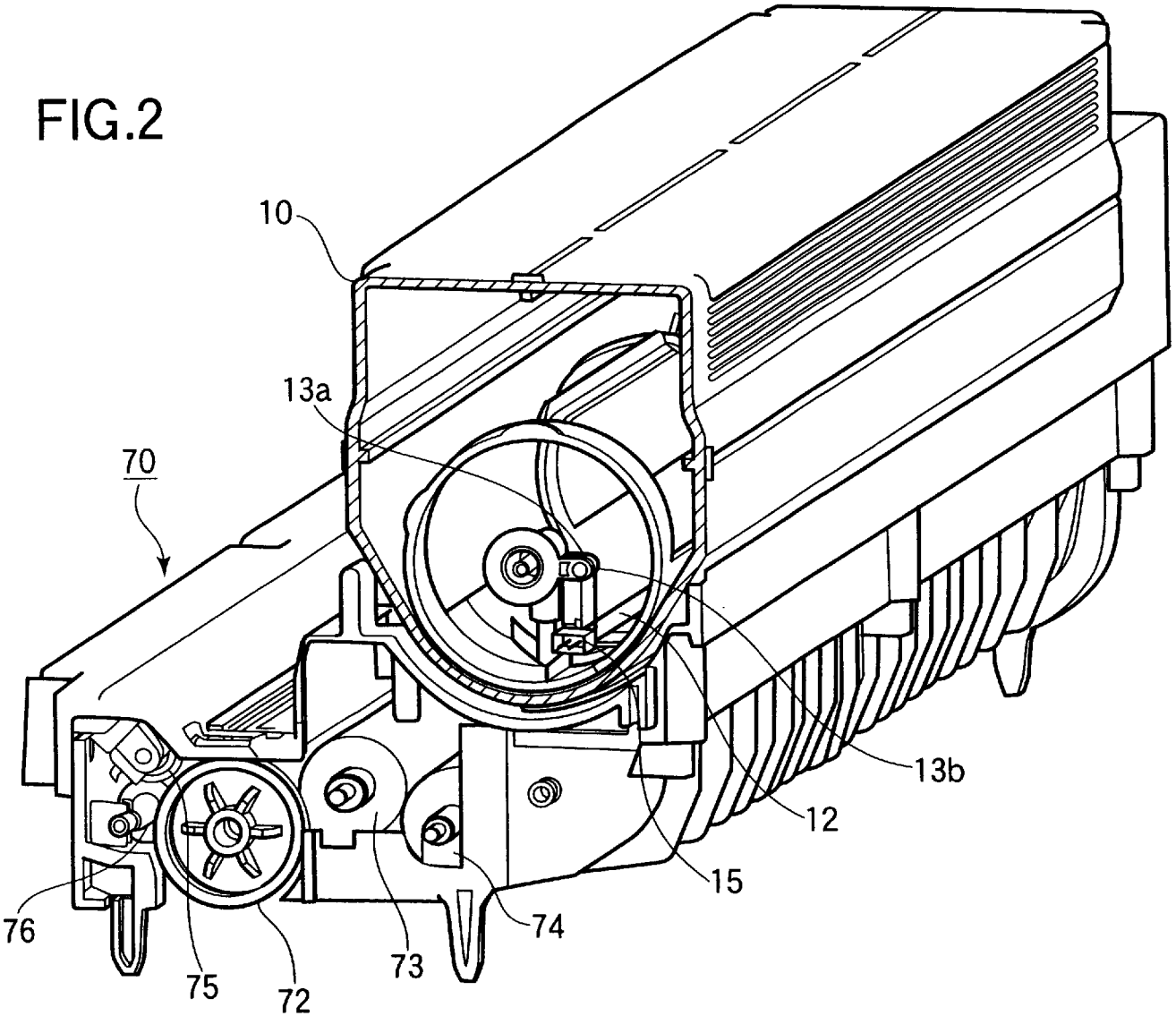
FIG. 2 is a perspective view with a partial cross-sectional view, illustrating an image-forming unit of the image-forming apparatus and a toner cartridge according to the first embodiment.

FIG. 2 is a perspective view with a partial cross-sectional view, illustrating an image-forming unit of the image-forming apparatus and a toner cartridge according to the first embodiment.

Figure 3:
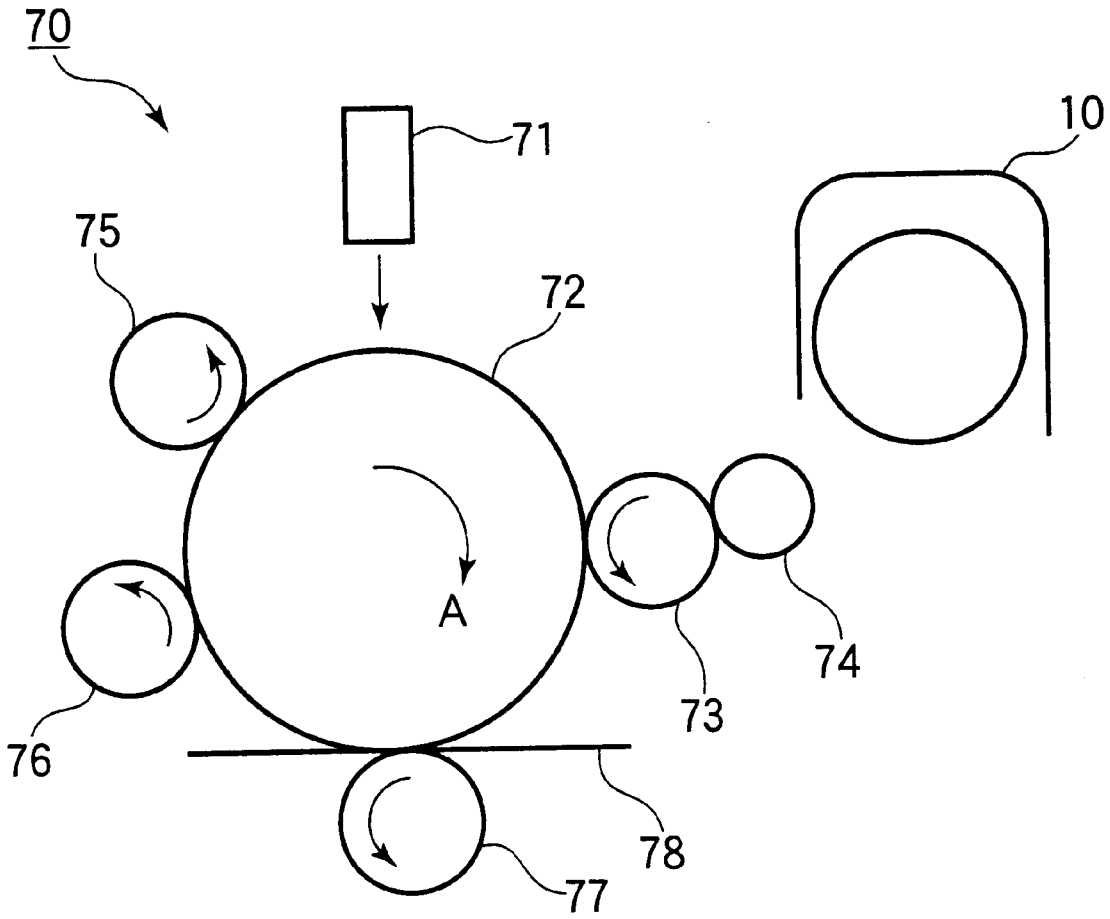
FIG. 3 is a model representation of the image-forming unit of FIG. 2.
Figure 6:
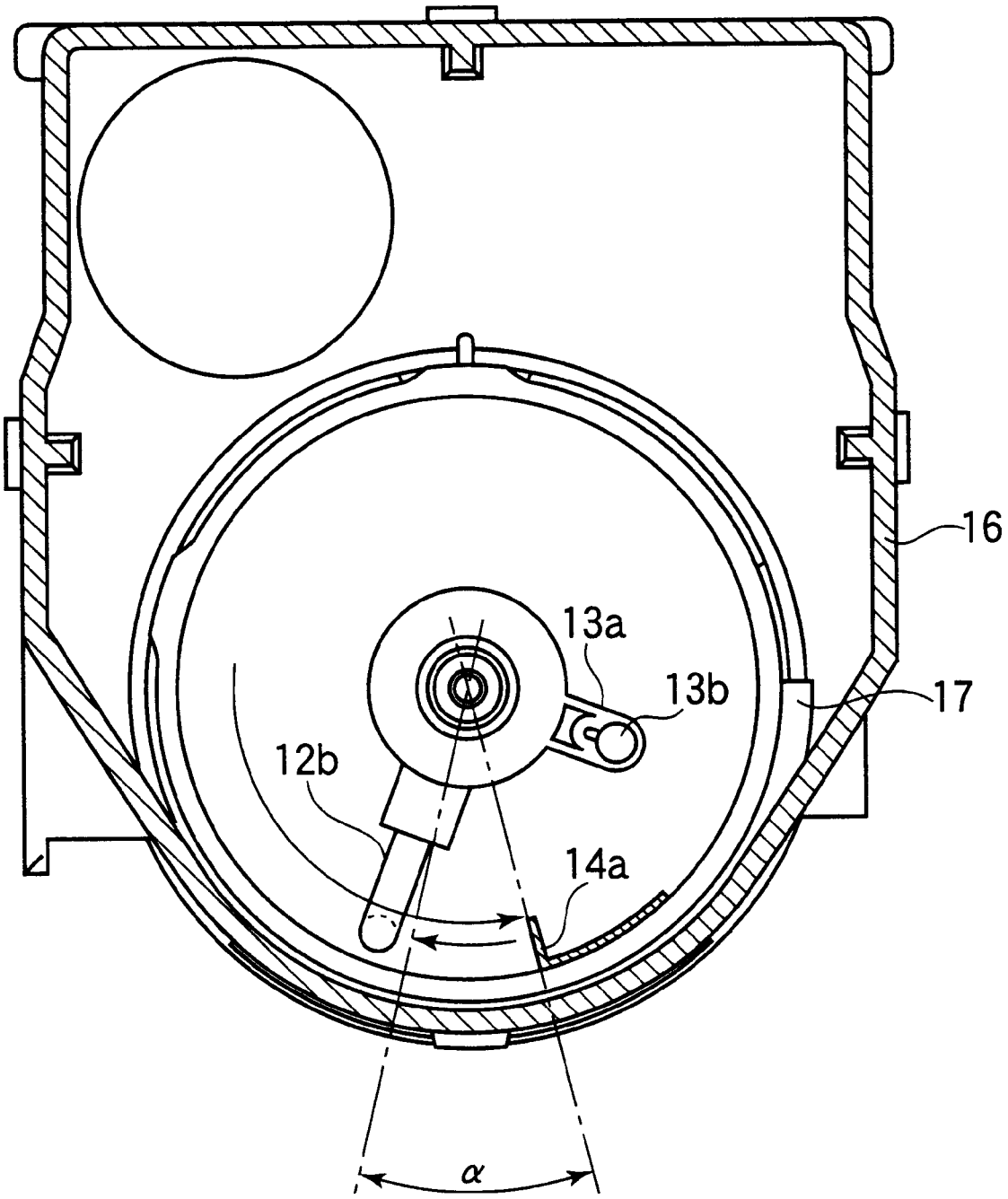
FIG. 6 illustrates the function of a damper according to the first embodiment.

FIG. 3 is a model representation of the image-forming unit of FIG. 6.

Referring to FIGS. 1 and 2, an image-forming apparatus has an image-forming unit 70 and a toner cartridge 10. The image-forming unit 70 is mounted on a side frame 80 assembled to the image-forming apparatus.

Referring to FIG. 3, the image-forming unit 70 includes a rotating photoconductive drum 72 and associated rotating structural elements. The photoconductive drum 72 rotates in a direction shown by arrow A. A charging roller 75 rotates in contact with the photoconductive drum 72 to charge the surface of the photoconductive drum 72 uniformly. An LED head 71 illuminates the charged surface of the photoconductive drum 72 in accordance with print data to form an electrostatic latent image on the photoconductive drum 72. A developing roller 73 rotates in contact with the photoconductive drum 72 to develop the electrostatic latent image with toner into a toner image. A toner-supplying roller 74 rotates in contact with the developing roller 73 to supply the toner to the developing roller 73. A toner cartridge 10 is disposed above the toner-supplying roller 74 to supply toner. A neutralizing and cleaning roller 76 rotates in contact with the photoconductive drum 72. A transfer roller 77 rotates in contact with the photoconductive drum 72 with a print medium 78 sandwiched between the transfer roller 77 and the photoconductive drum 72, so that the toner image is transferred electrostatically from the photoconductive drum 72 onto the print medium 78.

{Tone Cartridge}

The toner cartridge 10 holds toner therein. The toner is discharged from a lower portion of the toner cartridge 10 and supplied to the toner-supplying roller 74. The toner cartridge 10 includes a toner agitator 12 in the shape of a bar or rod, which is rotated by a gear 21 (FIG. 8) driven by a driving source, not shown. The toner agitator 12 agitates the toner to prevent the toner from clumping, so that the toner cartridge 10 discharges uniform toner particles.

The toner agitator 12 also serves as a part of a toner remaining indicator, which will be described later, that detects "a toner-low state" in which only a small amount of toner is left in the toner cartridge 10.

The toner agitator 12 is in the shape of a crank shaft and has a shaft 12*c*, a radial portion 12*b*, and a bar 12*a* formed in one piece construction. The toner agitator 12 also has a short bar 13*a* that projects radially from the shaft 12*c* and has a magnet 13*b* attached to a tip thereof. The toner agitator 12 rotates about the shaft 12*c* in a direction shown by arrow A, so that the bar 12*a* describes a circular rotational path in a toner holder 17. The radial portion 12*b* and the short bar 13*a* are angularly spaced apart by 90 degrees such that when the bar 12*a* is at its lowest position, the short bar 13*a* extends horizontally. A magnet-detecting sensor 15 is attached to the side frame 80 to oppose the magnet 13*b* at a position where the magnet takes up when the bar 12*a* is at its lowest position.

The magnet-detecting sensor 15 includes a magnetoresistive element such as Hall effect element that detects a magnetic field, and a connector that electrically connects the magnet-detecting sensor 15 and the control means, not shown, of the image-forming apparatus.

Figure 4:
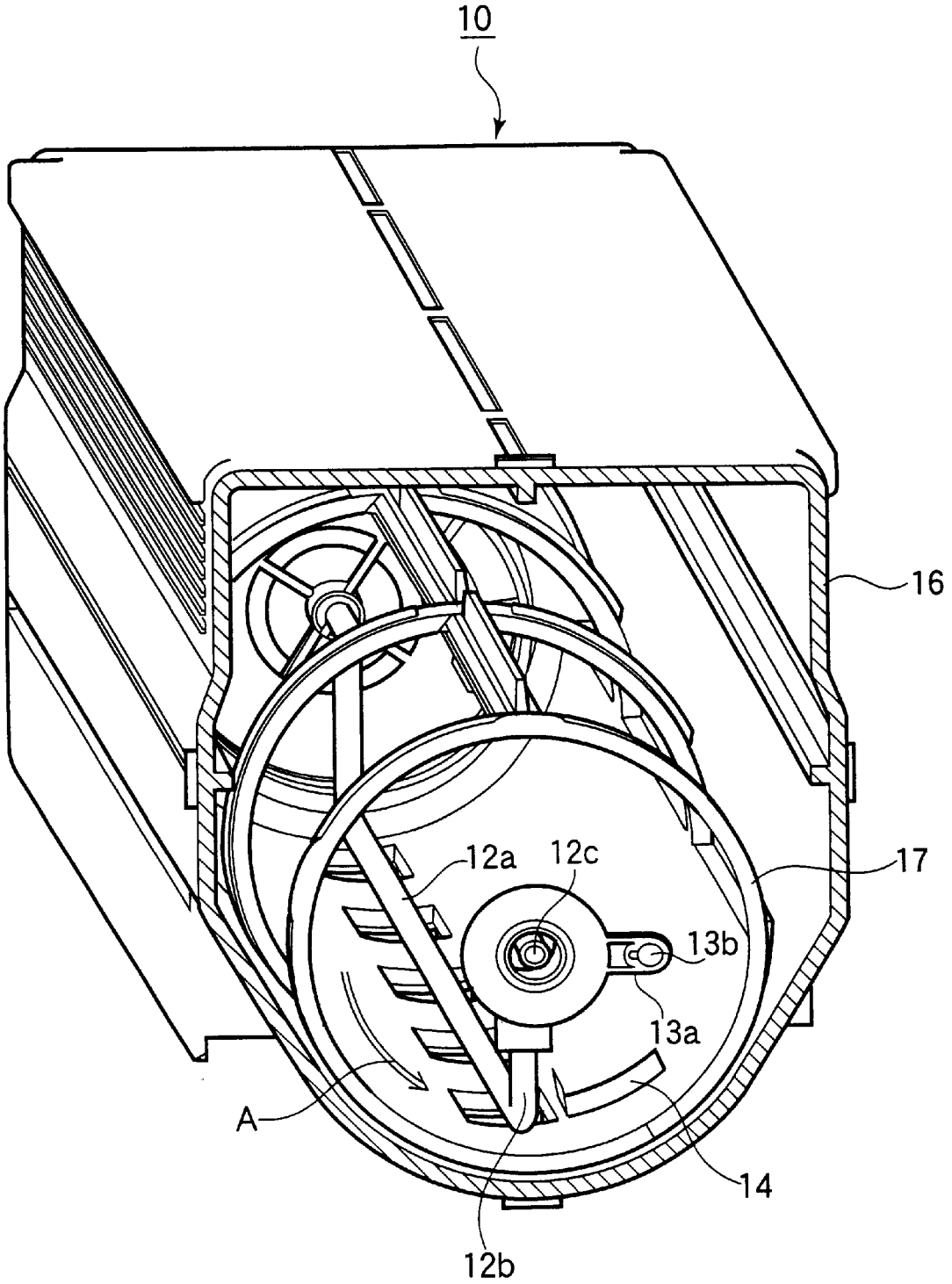
FIG. 4 is a perspective view with a partial cross-sectional view of the toner cartridge.

FIG. 4 is a perspective view with a partial cross-sectional view of the toner cartridge.

Referring to FIG. 4, the toner holder 17 is assembled into an outer case 16. The toner holder 17 has a plurality of large openings in its upper portion through which the toner flows into the toner holder 17 from the outer case 16. The toner holder 17 has a plurality of toner-discharging openings 18 formed in a bottom floor thereof. The toner is supplied through the toner-discharging openings 18 to the toner-supplying roller 74.

A damper 14 is provided on the inner surface of the toner holder 17 and serves as a device that progressively diminishes oscillatory motion of the bar 12*a* back and forth about a location at which a magnet detecting sensor 15 is disposed. The damper 14 is formed of a resilient resin material such as polyester and has a base portion 14*b* and a raised portion 14*a*. The base portion 14*a* is fixed to the inner surface of the toner holder 17 by, for example, an adhesive, the raised portion 14*a* extends into the path of the toner agitator and substantially traverses the circular rotational path of the bar 12*a*. The damper 14 is disposed so that the raised portion 14*a* is on the right end of an angular range $\alpha$ of FIG. 5, i.e., the raised portion 14*a* is at a downstream end of the angular range ($\alpha$) with respect to rotation of the toner agitator.

{Operation of Image Forming Unit}

When a printing operation is formed to form an image on the print medium, the photoconductive drum 72 (FIG. 2) is driven by a drive source, not shown, such as a motor to rotate clockwise. Then, the LED head 71 illuminates the surface of the photoconductive drum 72, charged by the charging roller 75, to form an electrostatic latent image. As the photoconductive drum 72 rotates, the electrostatic latent image is developed with toner by the developing roller 73 into a toner image.

The toner image is then transferred onto the print medium 78, advanced on a carrier belt, not shown, into a transfer point defined between the photoconductive drum 72 and the transfer roller 77.

Then, the print medium 78 is advanced to a fixing unit, not shown, where the toner image is fused into the print medium 78 into a permanent image. Then, the print medium 78 is discharged from the image-forming apparatus.

The cleaning roller 76 charges the surface of the photoconductive drum 72 on which the toner image was formed so that the surface is subjected to an electric field of a polarity opposite to that of the residual toner particles on the photoconductive drum 72. Thus, the cleaning roller 76 removes the residual toner particles on the photoconductive drum 72 and neutralizes the surface of the photoconductive drum 72. Thereafter, the surface of the photoconductive drum 72 is charged again uniformly by the charging roller 75.

The photoconductive drum 72 further continues to rotate to repeat the aforementioned steps of electrophotography.

{Operation of toner remaining indicator}

Figure 5:
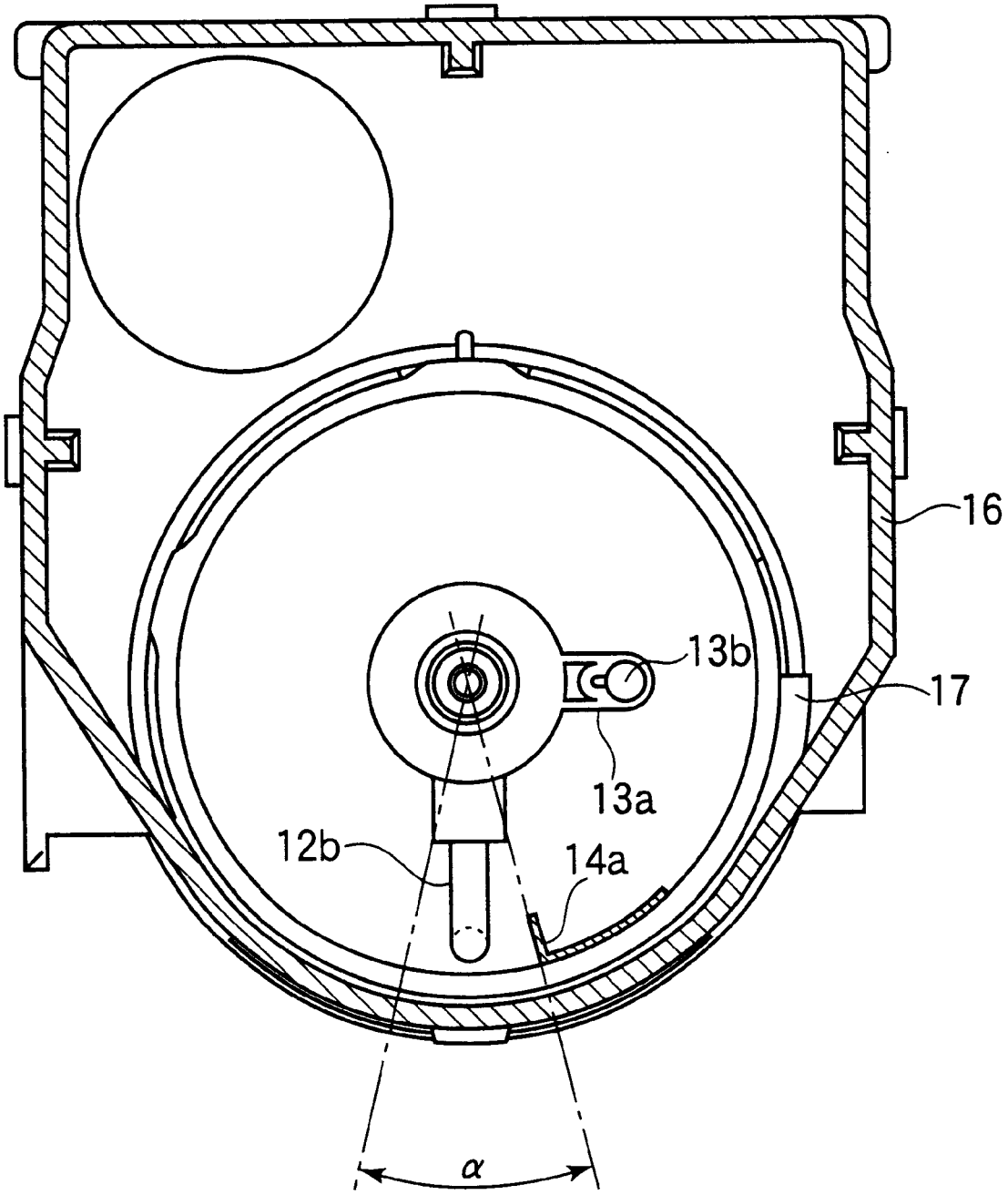
FIG. 5 is a cross-sectional view of the toner cartridge FIG. 4.

FIG. 5 is a cross-sectional view of the toner cartridge.

FIG. 6 illustrates the function of the damper of the invention.

Figure 7:
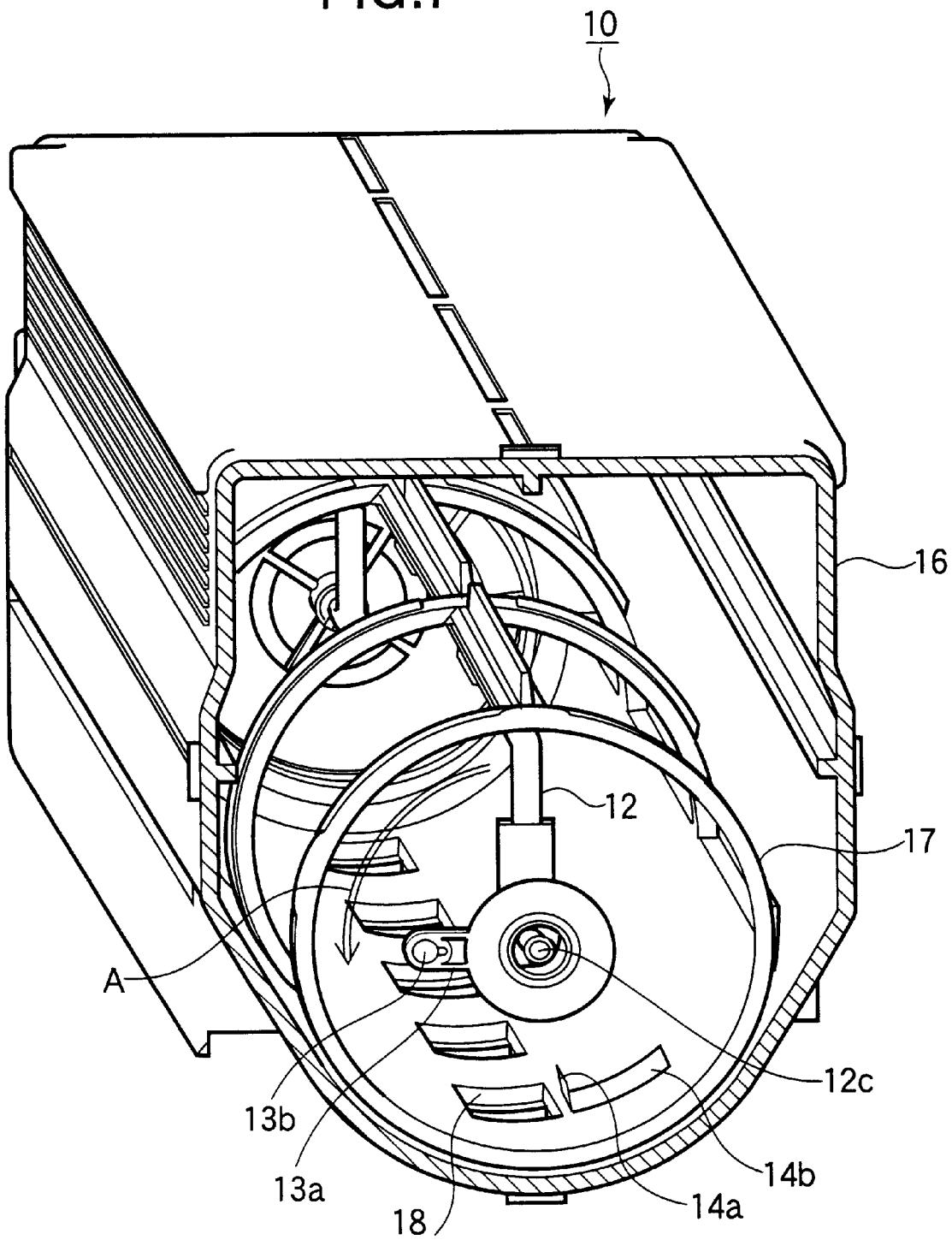
FIG. 7 is a perspective view with a partial cross-sectional view of the toner cartridge.

FIG. 7 is a perspective view with a partial cross-sectional view of the toner cartridge.

When the bar 12*a* of the toner agitator 12 rotates to its lowest position, it takes up a position as shown in FIG. 4. When the bar 12*a* of the toner agitator 12 rotates to its highest position, it takes up a position as shown in FIG. 7. When the bar 12*a* is within the angular range $\alpha$ as shown in FIG. 5, the magnet detecting sensor 15 detects the magnet 13*a*.

Figure 8:
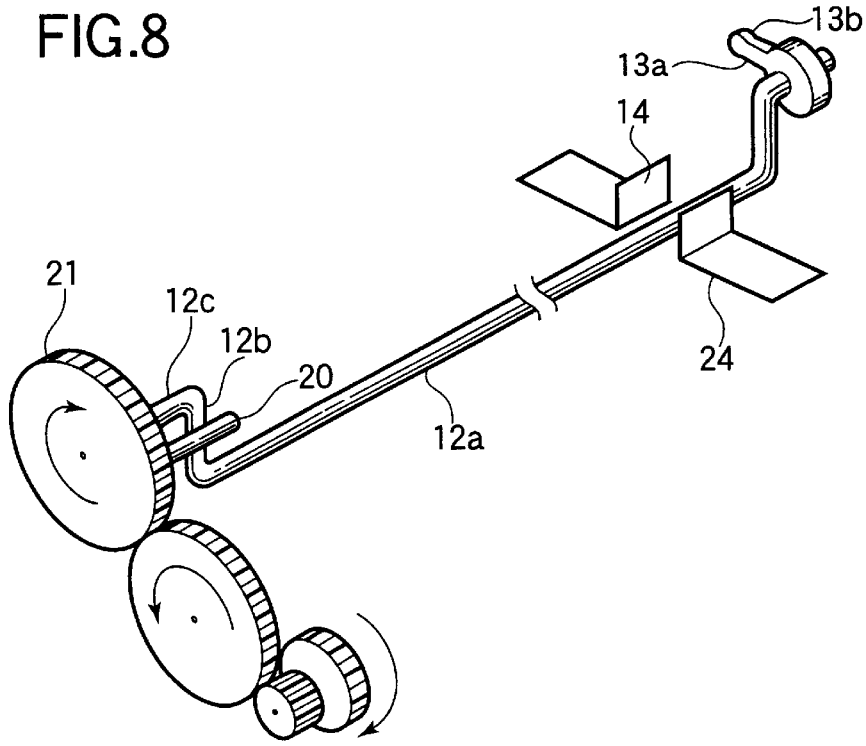
FIG. 8 illustrates a mechanism that causes a toner agitator to rotate.

FIG. 8 illustrates a mechanism that causes the toner agitator to rotate.

As shown in FIG. 8, when the gear 21 is driven in rotation by the drive source, not shown, a projection 20 on the gear 21 pushes the radial portion 12*b* in such a way that the toner agitator rotates in a direction shown by arrow.

Figure 9A:
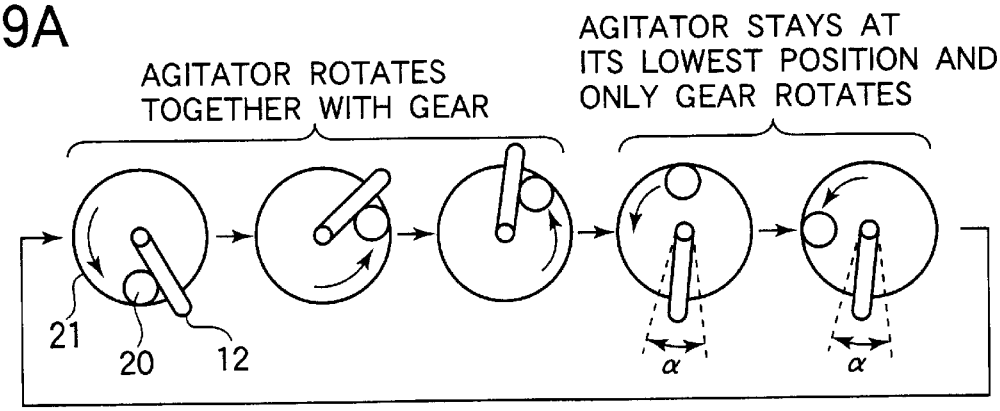
FIG. 9A illustrates the positional relation between a gear and the toner agitator when the toner cartridge holds a sufficient amount of toner.

FIG. 9A illustrates the positional relation between the gear and the toner agitator when the toner cartridge 10 holds a sufficient amount of toner.

If the toner cartridge 10 is almost full of toner, the projection 20 pushes the bar 12 to rotates together with the bar 12 until the bar 12*a* rotates past its highest position in the toner holder 17. When the bar reaches its highest position, the bar 12*a* drops suddenly from its highest position due to its own weight but lands and rests on the pile of toner. In this case, the bar 12*a* is outside of the angular range α and therefore the magnet-detecting sensor 15 does not generate an output. As the gear 21 rotates, the projection 20 again abuts the radial portion 12*b* of the toner agitator 12 and pushes it to rotate together with the gear 20, thereby agitating the toner. As the gear 21 further rotates, the bar 12*a* passes through the angular range α at the same speed as the gear, i.e., a fairly high speed. Therefore, the output of the magnet-detecting sensor 15 is of a short duration and does not indicate the "toner-low state."

Figure 9B:
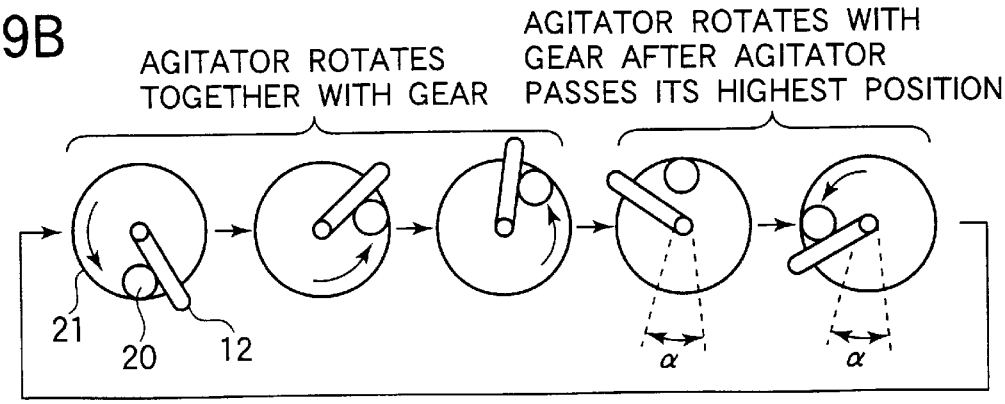
FIG. 9B illustrates the positional relation between the gear and the toner agitator when the toner cartridge is almost empty of toner.

FIG. 9B illustrates the positional relation between the gear and the toner agitator when the toner cartridge 10 is almost empty of toner.

If the toner cartridge 10 is almost empty of toner, the projection 20 pushes the bar 12 to rotates together with the bar 12 until the bar 12*a* rotates past its highest position in the toner holder 17. When the bar reaches its highest position, the bar 12*a* drops suddenly from its highest position due to its own weight to its substantially lowest position.

Thus, if the toner cartridge 10 is nearly empty of toner, the bar 12*a* that has dropped from its highest position does not receive very much resistance of toner and therefore travels through the angular range at a high speed. However, the bar 12*a* collides against the raised portion 14*a* of the damper 14.

The raised portion 14*a* is disposed on the right side end of the angular range α of FIG. 6. The damper 14 has a certain rigidity and resiliency such that the bar 12*a* cannot overcome the raised portion 14*a* but is repelled. As a result, the bar 12*a* stays within the angular range α until it is pushed by the projection 20 of the gear 21. In other words, the bar 12*a* stays within the angular range α for a longer time period when the toner cartridge 10 is nearly empty of toner than when the toner cartridge 10 holds a large amount of toner therein. Thus, the output of the toner-detecting sensor 15 indicates the toner-low state.

Since the raised portion 14*a* of the damper 14 has rigidity such that the raised portion 14*a* repels the bar 12*a* but yieldingly flex to allow the bar 12*a* to overcome the raised portion 14*a* when the projection 20 of the gear 21 pushes the radial portion 12*b*.

Second Embodiment

Figure 10:
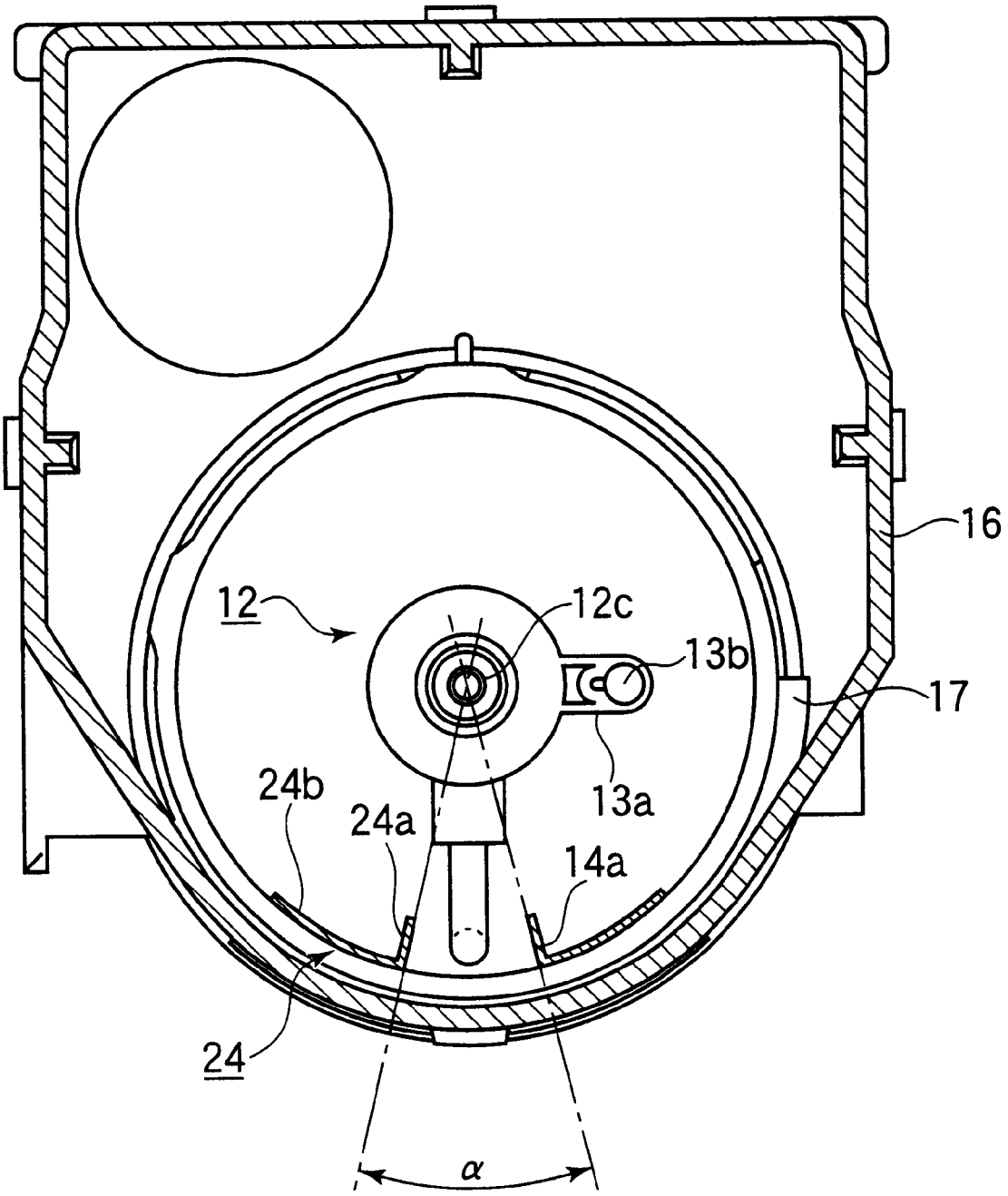
FIG. 10 is a cross-sectional view of a toner cartridge according to a second embodiment.

FIG. 10 is a cross-sectional view of a toner cartridge according to a second embodiment.

Figure 11:
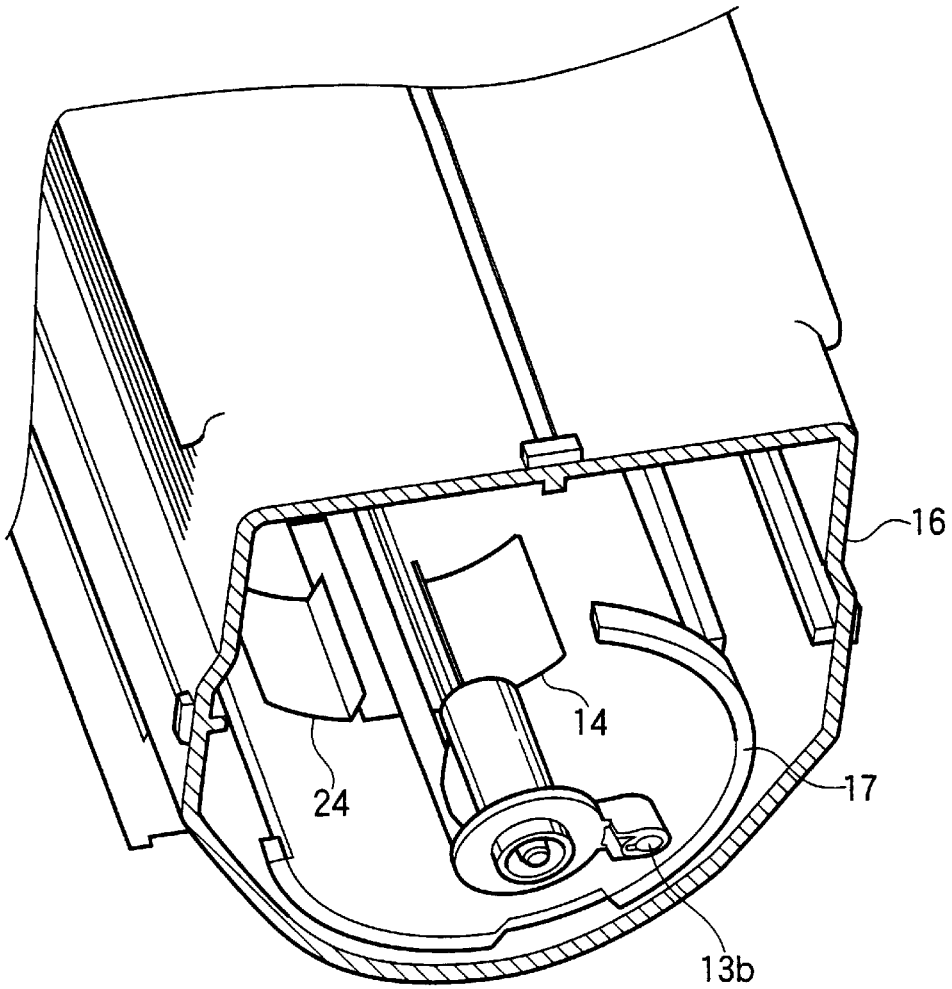
FIG. 11 is a perspective view with a partial cross-sectional view of the toner cartridge of FIG. 10.

FIG. 11 is a perspective view with a partial cross-sectional view of the toner cartridge of FIG. 10.

Elements similar to those of the first embodiment have been given the same reference numerals and the description thereof is omitted.

Another damper 24 is attached to an inner bottom surface of the toner holder 17. Abase portion 24*b* is fixed to the inner bottom surface of the toner holder 17 by an adhesive. The damper 24 is formed of the same material as the damper 14 and is of the same structure as the damper 14. The damper 24 is positioned such that a raised portion 24*a* is at the left end of the angular range α. In other words, the raised portion 24*a* and raised portion 14*a* are symmetric with respect to a vertical line passing through the shaft 12*c* such that the flat surface of the raised portion 14*a* opposes and is substantially parallel to the flat surface of the raised portion 24*a*. The raised portion 24*a* is disposed at an upstream end of the angular range α with respect to rotation of the toner agitator and the raised portion 14*a* is disposed at a downstream end of the range α with respect to rotation of the toner agitator.

{Operation of the Dampers}

Figure 12:
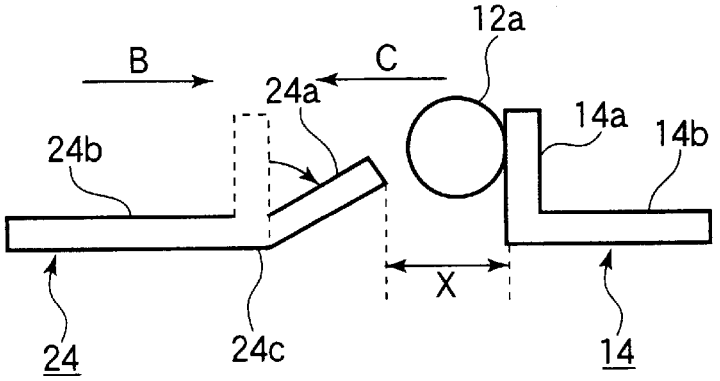
FIGS. 12–14 illustrate the operation of dampers according to the second embodiment.

FIG. 12 illustrates the operation of the dampers 14 and 24.

Figure 13:
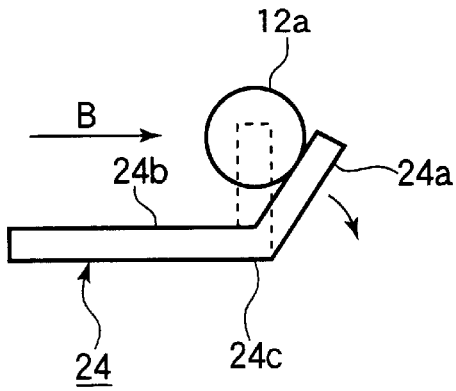

FIG. 13 illustrates the operation of the damper 24.

Figure 14:
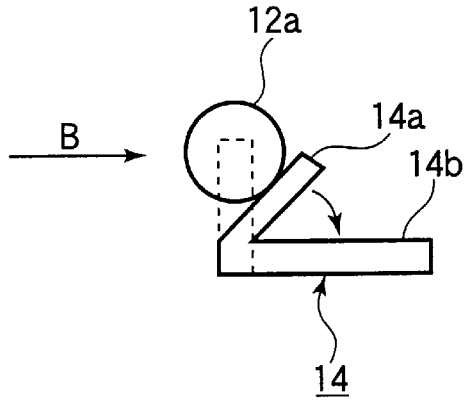

FIG. 14 illustrates the operation of the damper 14.

Figure 15:
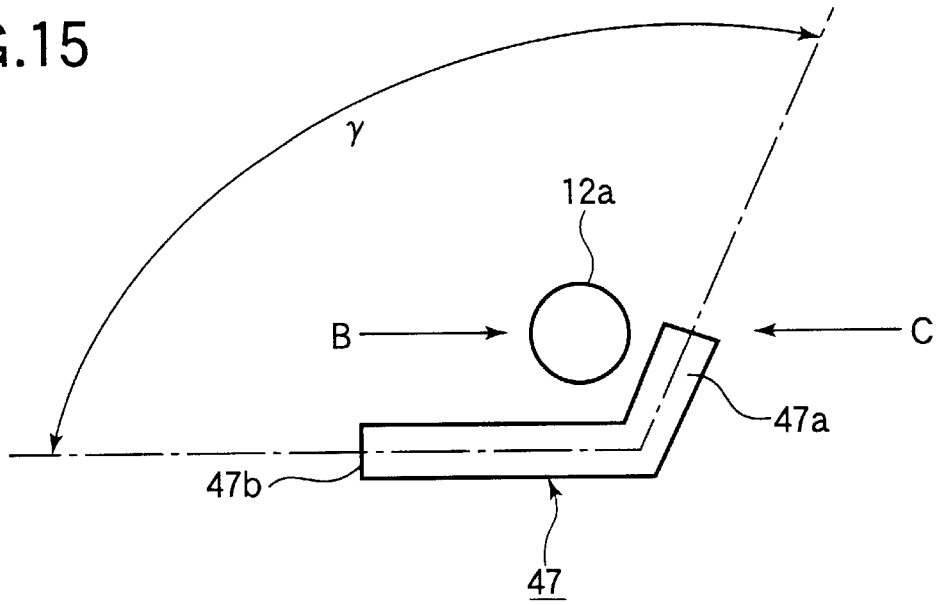
FIGS. 15, 16, and 17 show modifications of the damper.
Figure 16:
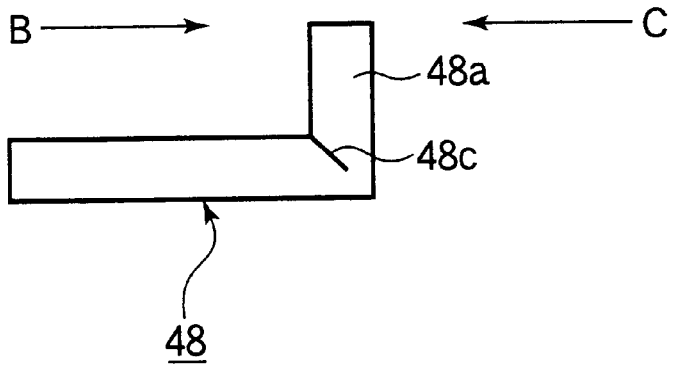
Figure 17:
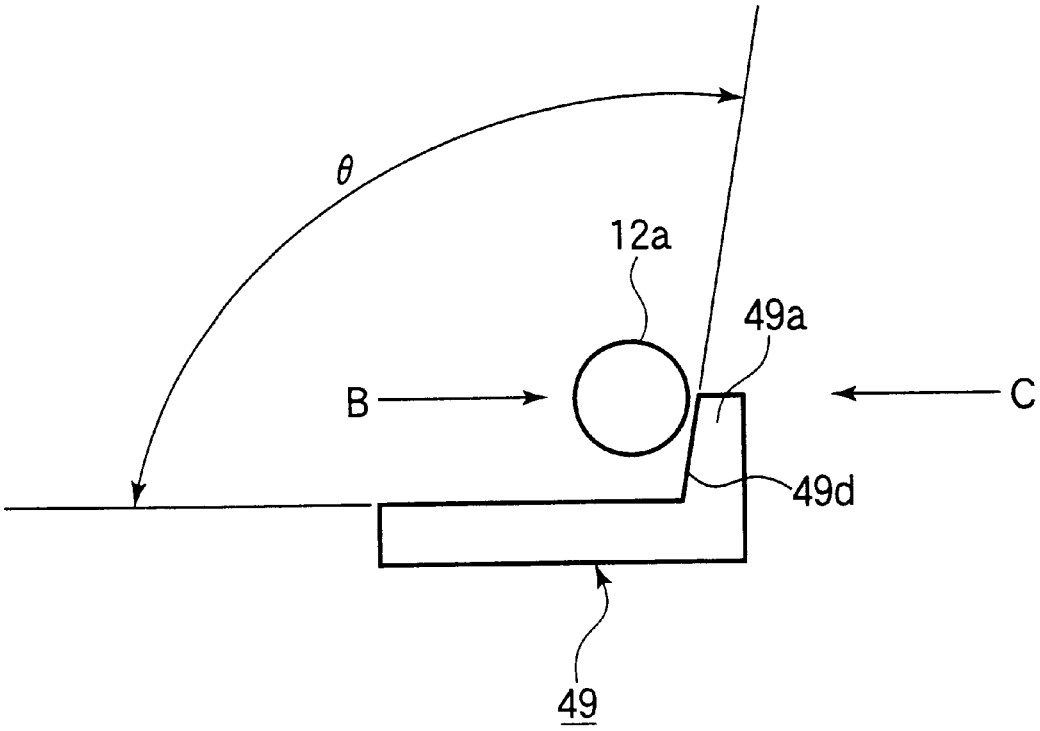

FIGS. 15, 16, and 17 show the modification of the damper 24.

When the toner cartridge 10 is almost empty of toner, the bar 12*a* that has dropped due to its own weight collides against the raised portion 24*a*. The raised portion 24*a* yieldingly flexes so that the bar 12*a* overrides the raised portion 24*a* to move past the raised portion 24*a* toward the raised portion 14*a* of the damper 14.

The bar 12*a* is then repelled by the raised portion 14*a* in a direction shown by arrow C to collide against the raised portion 24*a*. The impact exerted on the raised portion 24*a* by the bar 12*a* is weak and therefore the raised portion 24*a* does not yieldingly flex but repels the bar 12*a*. As a result, the bar 12*a* stays within the angular range α so that the output of the toner-detecting sensor 15 is of a long duration (FIG. 2) that indicates the toner-low state.

The dampers 14 and 24 are formed of a resin material such as polyester. The raised portion 24*a* exhibits less rigidity when the bar 12*a* collides against the raised portion 24*a* in such a direction as to open the damper (FIG. 13) than when the bar 12*a* collides against the raised portion 24*a* in such a direction as to fold the damper (FIG. 14).

Referring to FIG. 12, the dampers 14 and 24 are positioned relative to each other such that when the bar 12*a* collides against the raised portion 24*a*, the distance X between the raised portion 24*a* and the raised portion 14*a* is much larger than the diameter of the bar 12*a*. When the bar 12*a* overrides the raised portion 24*a* in the B direction, the raised portion 24*a* quickly regains its original position shortly after it flexes yieldingly. Therefore, when the bar 12*a* swings in the C direction of FIG. 12, the bar 12*a* does not override the raised portion 24*a*.

In order to increase rigidity of the damper 47 in the C direction and decrease the rigidity in the B direction, a damper 47 may be formed such that the angle γ between the raised portion 47*a* and the base portion 47*b* is larger than 90 degrees as shown in FIG. 15.

Alternatively, a damper 49 may be cut partly in a portion about which the damper 49 is bent into a raised portion 49*d* and a base portion 49*a* to make an angle of about 90 degrees. The damper 49 has smaller rigidity when the bar 12*a* collides against the damper 49 in the B direction and larger rigidity when the bar 12*a* collides against the damper 49 in the C direction. Thus, the damper 49 is difficult to be overridden by the bar 12*a* when the bar 12*a* collides against the damper 49 in the C direction.

As shown in FIG. 17, the damper 49 may be formed such that the raised portion 49*a* of the damper 49 is tapered and the raised portion 49*a* makes an angle θ larger than 90 degrees with the base portion 49*b*. In this case, too, as shown in FIG. 17, the damper 49 has a small rigidity when the bar 12*a* collides against the damper 49 in the B direction and a large rigidity when the bar 12*a* collides against the damper 49 in the C direction.

The damper 14 may also be modified in the same way as shown FIGS. 15 to 17.

Third Embodiment

Figure 18:
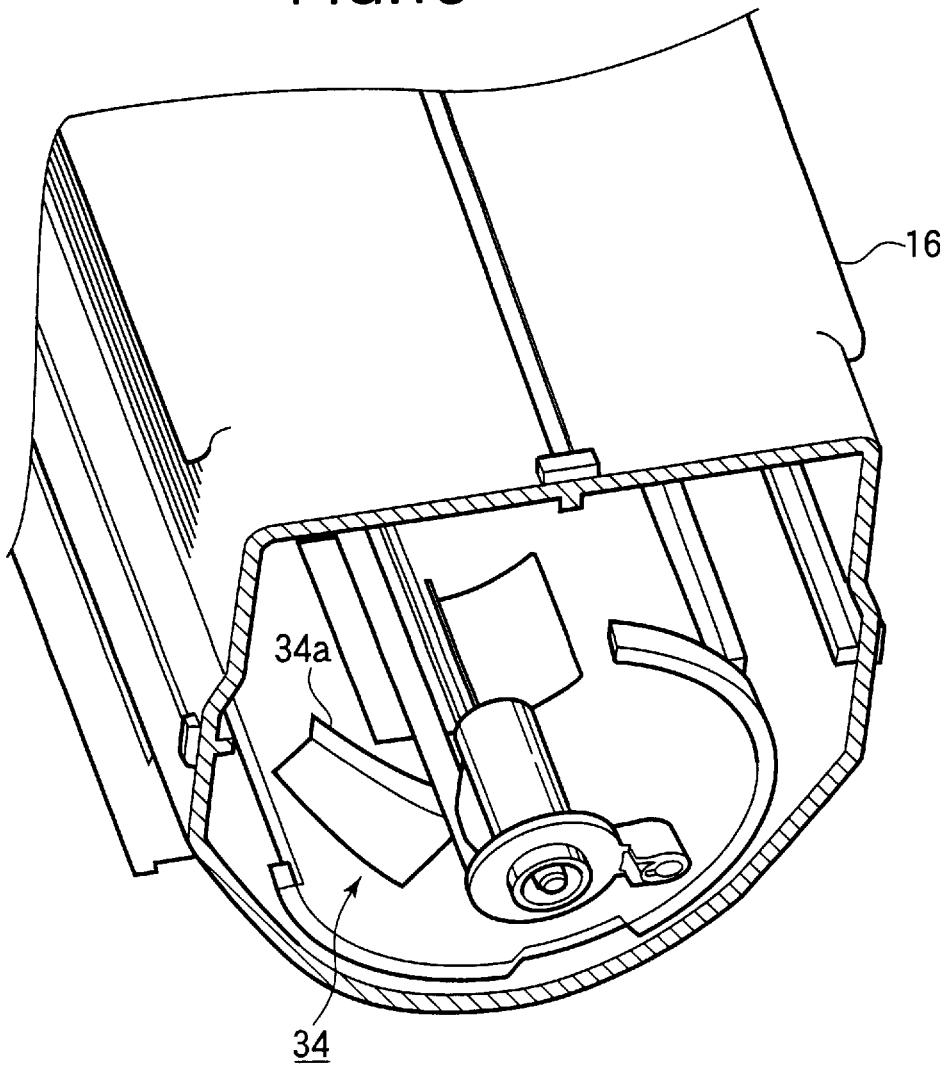
FIG. 18 is a perspective view with a partial cross-sectional view, illustrating a toner cartridge according to a third embodiment.

FIG. 18 is a perspective view with a partial cross-sectional view, illustrating a toner cartridge according to a third embodiment.

Figure 19:
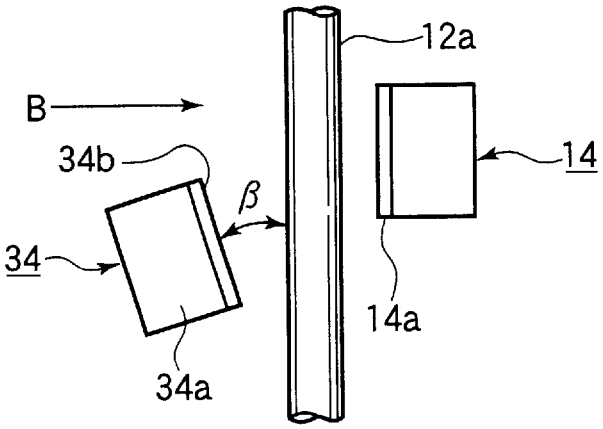
FIG. 19 illustrates dampers, as seen from above, according to the third embodiment.

FIG. 19 illustrates dampers as seen from above according to the third embodiment.

Elements similar to those of the first and second embodiments have been given the same reference numerals and the description thereof is omitted.

A damper 34 is positioned as shown in FIG. 19 such that the flat surface of the raised portion 34*a* lies in a plane at an angle β with a plane in which the raised portion 14*a* lies or a vertical plane passing through the shaft 12*c*.

The dampers 14 and 34 are positioned relative to each other such that when the bar 12*a* collides against the raised portion 24*a*, the distance X between the raised portion 34*a* and the raised portion 14*a* is much longer than the diameter of the bar 12*a*. It is ensured that the distance X is within the angular range α of FIG. 10.

If the toner cartridge 10 is almost empty of toner, when the bar 12*a* drops due to its own weight from its highest position, the bar 12*a* first swings in the B direction to collide against the raised portion 34*a* at a corner portion 34*b* and then progressively across entire raised portion 34*a*. When the bar 12*a* collides against the corner portion 34*b*, the rigidity is small and gradually increases as the bar 12*a* collides against the entire raised portion 34*a*.

Therefore, even if the bar 12*a* has a small kinetic energy when it collides against the corner portion 34*b*, the bar 12*a* is not repelled by the raised portion 34*b* but overrides the raised portion 34*b* into the angular range α, so that the toner-low state is reliably detected.

Fourth Embodiment

Elements similar to those of the first to third embodiments have been given the same reference numerals and the description thereof is omitted.

Figure 20:
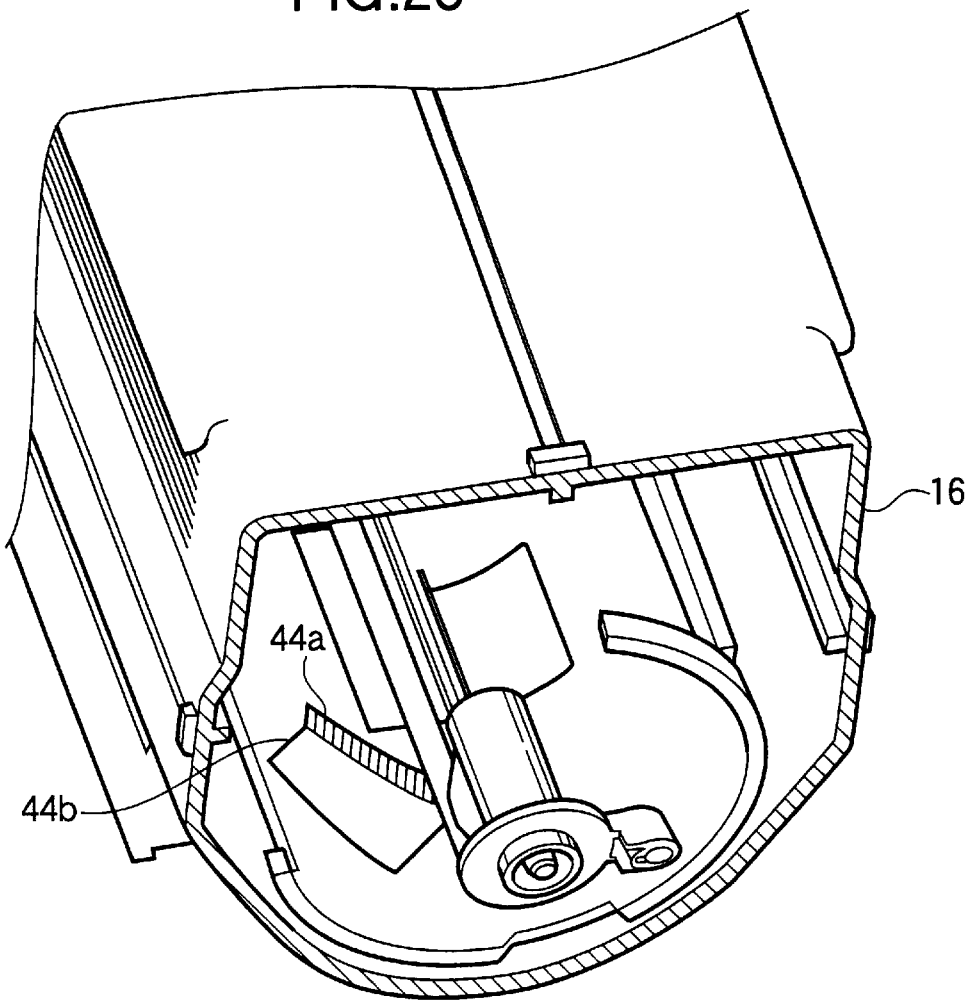
FIG. 20 is a perspective view with a partial cross-sectional view of a toner cartridge according to a fourth embodiment.

FIG. 20 is a perspective view with a partial cross-sectional view of a toner cartridge according to a fourth embodiment.

Figure 21:
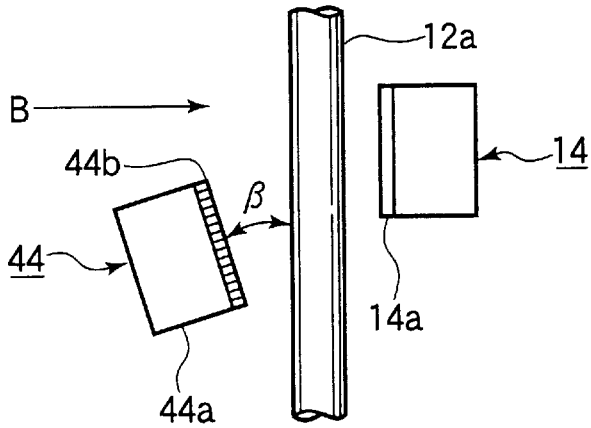
FIG. 21 illustrates dampers, as seen from above, according to the fourth embodiment.

FIG. 21 illustrates dampers according to the fourth embodiment.

Figure 22:
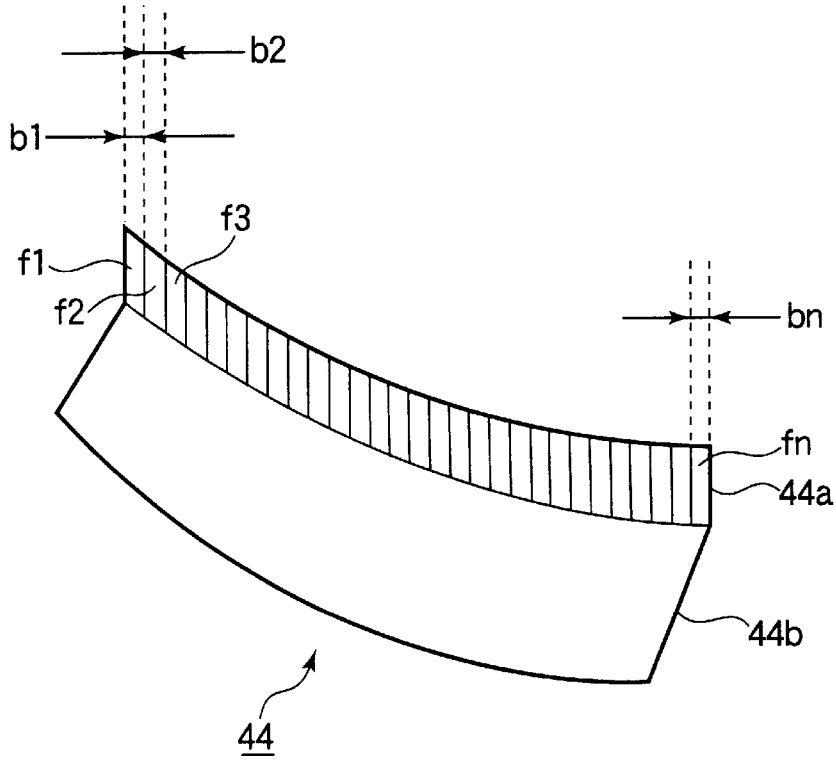
FIG. 22 is a perspective view of the damper.

FIG. 22 is a perspective view of the damper.

A damper 44 includes a raised portion 44*a* and a base portion 44*b*. The damper 44 is positioned as shown in FIG. 21 such that the flat surface of the raised portion 44*a* lies in a plane at an angle β with a plane in which the raised portion 14*a* lies or a vertical plane passing through the shaft 12*c*. The raised portion 44*a* is separated by slits into a plurality of fingers f1 to fn. The fingers have widths b1, b2, b3, . . . bn, which may be the same or different.

If the toner cartridge 10 is almost empty of toner, when the bar 12*a* swings in the B direction, the bar 12*a* collides against a corner portion 44*b* of the raised portion 44*a* and then swings further overriding the fingers progressively toward the damper 14. The bar 12*a* receives progressively large repelling force b1, b1+b2, b1+b2+b3, b1+b2+b3+b4, . . . , b1+b2+ . . . +bn.

Thus, even if the bar 12*a* has a small kinetic energy when it collides against the corner portion 44*b*, the bar 12*a* is not repelled by the corner portion 44*b* but overrides the corner portion 44*b* toward the raised portion 14. The bar 12*a* then collides against the damper 14 and is repelled back toward the raised portion 44*a*. The raised portion 44*a* repels the bar 12*a*, so that the bar 12*a* can be within the angular range of FIG. 10. In this manner, the toner-low state is reliably detected.

In the first to fourth embodiments, the dampers are formed of a resin material such as polyester and are attached to the inner surface of the toner holder 17 by an adhesive. The dampers may be of any type of retarding element, provided that when the bar 12*a* swings to collide against the corner portion 44*b*, the rotation of the toner agitator 12 is retarded.

Figure 23A:
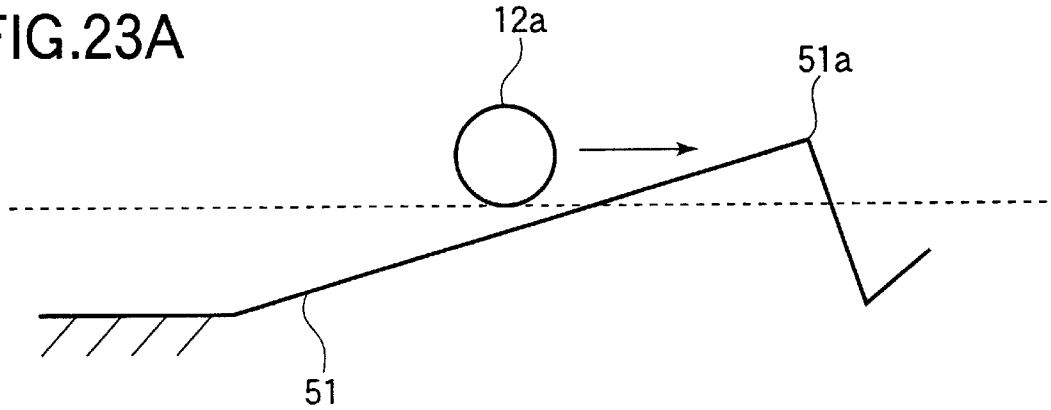
FIGS. 23A and 23B are side views, illustrating a modification of the damper.
Figure 23B:
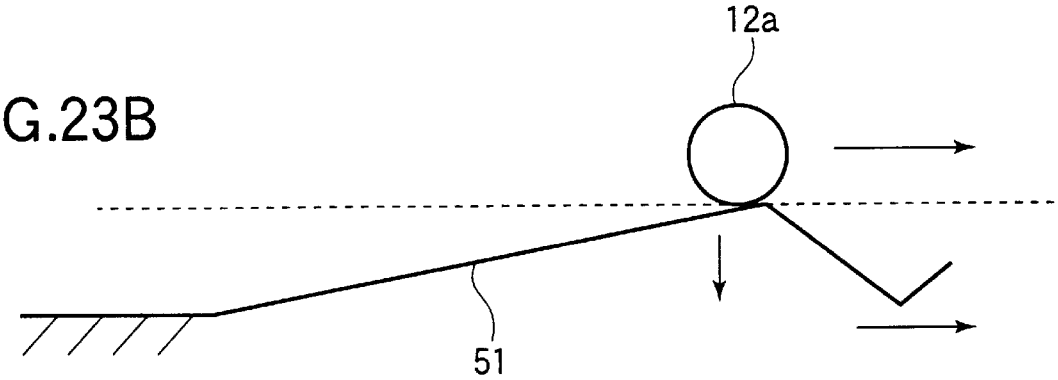

FIGS. 23A and 23B are side views, illustrating a modification of the damper.

Figure 24:
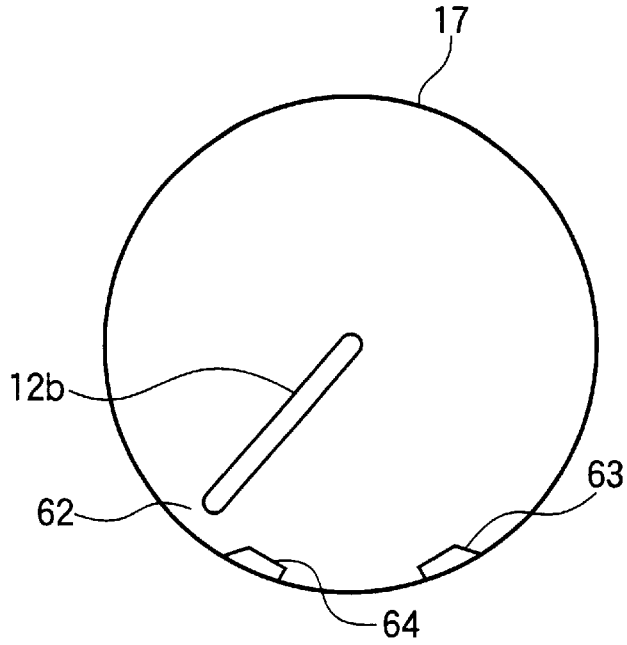
FIG. 24 is a cross-sectional side view, illustrating another modification of the damper.
Figure 25:
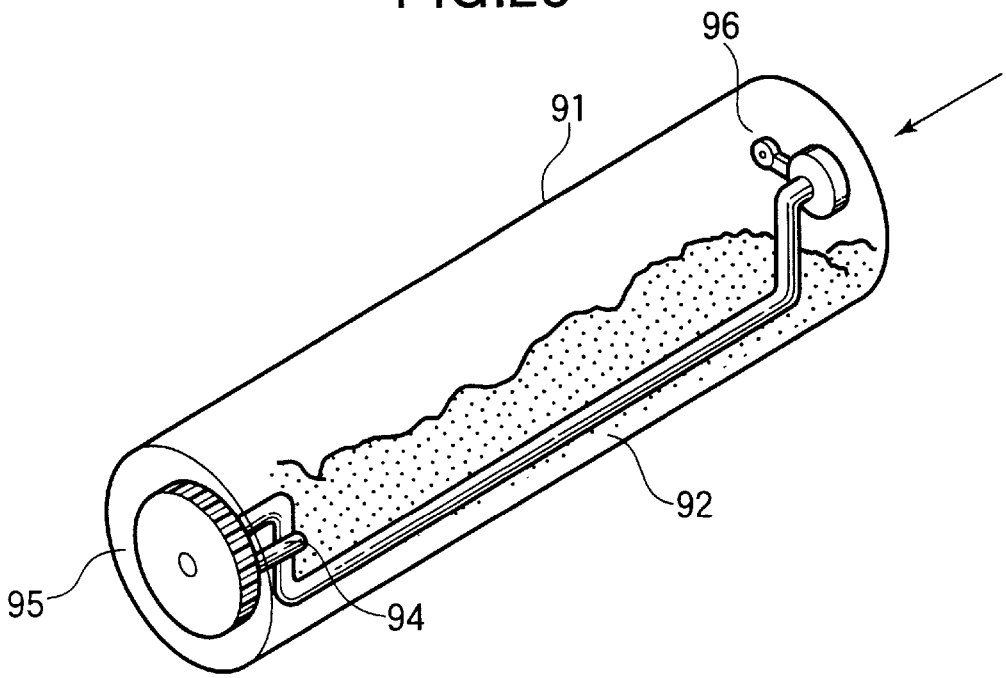
FIG. 25 illustrates a conventional toner chamber and a toner agitator provided therein.
Figure 26:
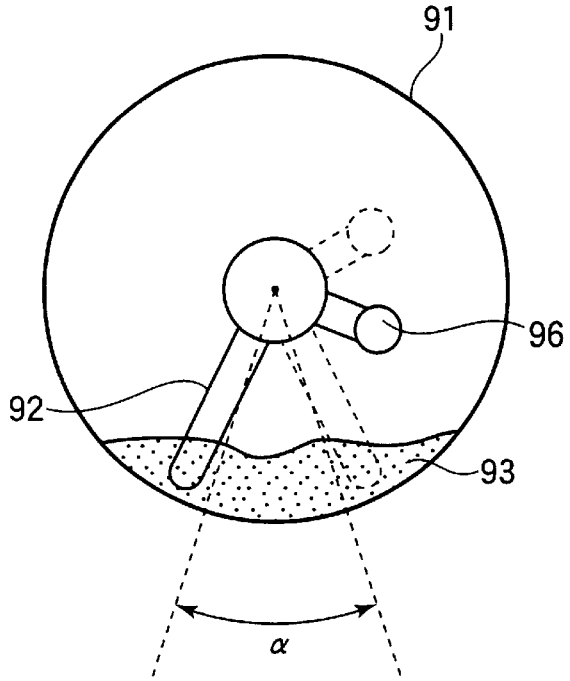
FIG. 26 illustrates a toner chamber of a conventional toner cartridge when the toner chamber is nearly empty of toner.
Figure 27:
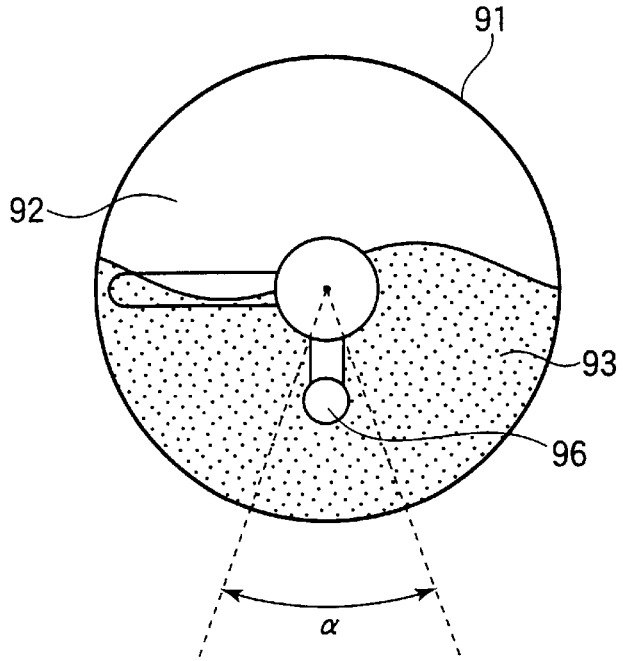
FIG. 27 illustrates the toner chamber of the conventional toner chamber when the toner chamber holds a sufficient amount of toner.
Figure 28:
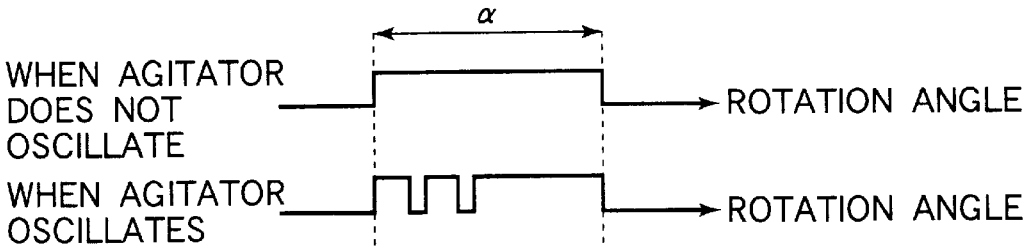
FIG. 28 illustrates the output signal of a toner sensor indicative of the remaining toner in the toner chamber.

FIG. 24 is a cross-sectional side view, illustrating another modification of the damper.

Referring to FIGS. 23A and 23B, a retarding member 51 is a flat spring formed of a flexible metal material element. The retarding member 51 is mounted on the inner surface of the toner holder 17. As shown in FIGS. 23A and 23B, when the bar 12*a* collides against a folded portion of the retarding member 51, the bar 12*a* causes the retarding member 51 to be deformed into a flatter shape. The deformation of the retarding member 51 absorbs the kinetic energy when the bar 12*a* collides against the retarding member 51.

Referring to FIG. 24, projections 63 and 64 may be formed on the inner surface of the toner holder 17 so that the projectiosn 63 and 64 serve as a retarding member. The radial portion 12*b* of the toner agitator 12 has a film-like element that collides against the projections 63 and 64, thereby being retarded in swinging motion.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner cartridge comprising:

a toner holding section, holding toner therein;

a toner agitator disposed in said toner holding section, said toner agitator being free to rotate, said toner agitator being driven in rotation to agitate the toner when it is pushed to rotate;

a damper, damping motion of said toner agitator when said toner agitator rotates freely, said damper being disposed in said toner holding section; and a position indicator attached to said toner agitator and indicating a rotational position of said toner agitator.

2. The toner cartridge according to claim 1, wherein said damper is disposed in a path through which said toner agitator rotates, said damper defining an angular range through which said toner agitator rotates while said position indicator is detected by an external device.

3. The toner cartridge according to claim 2, wherein said damper is formed of a resilient film material and is bent into a first portion and a second portion;

wherein the first portion is fixed to an inner surface of said toner holding section and the second portion extends into the path.

4. The toner cartridge according to claim 3, wherein the second portion exhibits a first resistance against a first force that causes the second portion to deform inwardly relative to the angular range and a second resistance against a second force that causes the second portion to deform outwardly relative to the angular range.

5. The toner cartridge according to claim 3, wherein said damper is one of two dampers;

wherein a first one of the two dampers is disposed at an upstream end of the angular range with respect to rotation of said toner agitator and a second one of the two dampers is disposed at a downstream end of the angular range with respect to rotation of said toner agitator, the second portion of the second one of the two dampers lying in a plane at an angle with a plane in which the second portion of the first one of the two dampers lies.

6. The toner cartridge according to claim 2, wherein said toner agitator stays in the angular range for a shorter time when said toner cartridge holds a larger amount of toner therein than when said toner cartridge is nearly empty of toner.

7. The toner cartridge according to claim 3, wherein said second portion has a plurality of slits extending in a direction in which the second portion extends.

8. The toner cartridge according to claim 7, wherein said toner agitator is pushed by a drive member to rotate about a substantially horizontal axis;

wherein when said toner agitator is rotated past its vertical highest position, said toner agitator drops from the vertical highest position due to its own weight;

wherein when said toner agitator is substantially in the angular range, the external device detects the magnetic field.

9. The toner cartridge according to claim 7, wherein said position indicator is a magnet attached to said toner agitator, the magnet radiating a magnetic field that is detected by the external device.

10. A toner remaining detector for detecting a remaining amount of toner in a toner chamber, the detector comprising:

a toner agitator disposed in the toner chamber, the toner agitator being rotated about an axis to agitate the toner;

a position indicator attached to said toner agitator and transmitting a signal indicating a rotational angle of said toner agitator when said toner agitator rotates, the signal being detected by an external detecting device;

a damper, damping motion of said toner agitator when said toner agitator rotates.

11. The toner remaining detector according to claim 10, wherein said damper is disposed in a path through which said toner agitator rotates, said damper damping the motion of said toner agitator when said toner agitator is within a range of rotational angle.

12. The toner remaining detector according to claim 11, wherein said damper is formed of a resilient film material bent into a first portion fixed to an inner surface of the toner chamber and a second portion extending into the path.

13. The toner remaining detector according to claim 12, wherein said damper is one of two dampers;

wherein a first one of the two dampers is disposed at an upstream end of the range of rotational angle with respect to rotation of said toner agitator and a second one of the two dampers is disposed at a downstream end of the range of rotational angle with respect to rotation of said toner agitator.

14. The toner remaining detector according to claim 12, wherein the second portion of the first one of the two dampers has a plurality of slits formed therein.

15. The toner remaining detector according to claim 12, wherein the second one of the two dampers is disposed such that the second portion lies in a plane at an angle with the axis.

16. The toner remaining detector according to claim 12, wherein said toner agitator is rotatable freely about the axis;

wherein the second portion operates such that when said toner agitator rotates freely within the range of rotational angle, the second portion repels said toner agitator to stay within the range of rotational angle; and wherein the second portion operates such that when said toner agitator is rotated by the drive member, the second portion allows said toner agitator to move out of the range of rotational angle.

17. The toner remaining detector according to claim 10, wherein said toner agitator is pushed by a drive member to rotate about a substantially horizontal axis;

wherein when said toner agitator is rotated past its vertical highest position, said toner agitator drops from the vertical highest position due to its own weight and rotates about the substantially horizontal axis;

wherein when said toner agitator is substantially in the range of rotational angle, the signal is detected.

18. The toner remaining detector according to claim 17, wherein said position indicator is a magnet attached to said toner agitator and radiates a magnetic field:

wherein the external device is a magnetoresistive element and detects the magnetic field.

19. The toner remaining detector according to claim 17, wherein the toner agitator stays within the first range of rotational angle for a shorter time period when the toner chamber holds a larger amount of toner therein than when the toner chamber holds a smaller amount of toner therein.

20. An image-forming unit to which a toner cartridge is attached, the toner cartridge including a toner agitator free to rotate and a position indicator that indicates a rotational position of the toner agitator, the toner agitator being driven in rotation when it is pushed to rotate, the image-forming unit comprising:

a space that receives the toner cartridge therein; and a detector that detects the position indicator when the position is at a certain rotational position.

21. The image-forming unit according to claim 20, wherein the position indicator is a magnet that radiates a magnetic field and said detector is a magnetoresistive element that detects the magnetic field.

22. The image-forming unit according to claim 21, wherein the toner agitator is pushed by a drive member to rotate about a substantially horizontal axis;

wherein when the toner agitator is rotated past its vertical highest position, the toner agitator drops from the vertical highest position due to its own weight;

wherein when the toner agitator is substantially in the range of rotational angle, the detector detects the magnetic field.

* * * * *